US009423228B2

(12) United States Patent
Moan et al.

(10) Patent No.: US 9,423,228 B2
(45) Date of Patent: Aug. 23, 2016

(54) ADVANCED FRAGMENTATION HAND GRENADE

(71) Applicant: The United States of America as represented by the Secretary of the Navy, Washington, DC (US)

(72) Inventors: Brad Moan, Greenwood, IN (US); Eric Scheid, Bloomington, IN (US); Lucas Allison, Washington, IN (US); Nishkamraj Deshpande, Novi, MI (US)

(73) Assignee: The United States of America as represented by the Scretary of the Navy, Washington, DC (US)

( * ) Notice: Subject to any disclaimer, the term of this patent is extended or adjusted under 35 U.S.C. 154(b) by 97 days.

(21) Appl. No.: 14/509,386

(22) Filed: Oct. 8, 2014

(65) Prior Publication Data

US 2016/0047641 A1 Feb. 18, 2016

Related U.S. Application Data

(60) Provisional application No. 62/020,109, filed on Jul. 2, 2014.

(51) Int. Cl.

| | |
|---|---|
| ***C06B 21/00*** | (2006.01) |
| ***F42B 27/00*** | (2006.01) |
| ***F42C 19/08*** | (2006.01) |
| ***F42B 33/00*** | (2006.01) |
| ***F42B 12/22*** | (2006.01) |
| ***F42B 12/72*** | (2006.01) |

(52) U.S. Cl.

CPC ..... *F42B 27/00* (2013.01); *F42B 12/22* (2013.01); *F42B 12/72* (2013.01); *F42B 33/00* (2013.01); *F42C 19/08* (2013.01)

(58) Field of Classification Search

CPC ..... F42B 27/00; F42B 33/00; F42B 12/22; F42B 12/72; F42C 19/08

USPC ..... 102/487, 493, 494; 86/1.1, 51, 53, 19.5

See application file for complete search history.

(56) References Cited

U.S. PATENT DOCUMENTS

| | | | | | |
|---|---|---|---|---|---|
| 3,926,122 | A * | 12/1975 | Wolterman | F42C 15/22 | 102/226 |
| 4,043,808 | A * | 8/1977 | Watmough | F42B 12/76 | 420/104 |
| 4,383,468 | A * | 5/1983 | Sie | B29C 41/04 | 102/496 |
| 4,574,702 | A * | 3/1986 | Brandt | F42B 10/48 | 102/244 |
| 4,699,063 | A * | 10/1987 | Aschwanden | F42B 8/26 | 102/482 |

(Continued)

*Primary Examiner* — Michelle R Clement

(74) *Attorney, Agent, or Firm* — Christoper A. Monsey

(57) ABSTRACT

A fragmentation structure is provided with improved performance e.g., fragmentation, projectile generation, storage, and manufacturing. An embodiment can include an open fragmentation structure that can be separated into individual components that can include a structure body section with a compartment, a removable initiator or detonator, a top cap section having an aperture configured to accept the removable initiator or removable detonator, and an explosive. An exemplary explosive can be preassembled to fit within the structure without a need for pouring in an explosive. An exemplary structure or top cap of the structure can receive an embrittlement treatment increasing its fragmentation characteristics. An ability of the structure to be easily disassembled allows for safer storage and a longer shelf life. A design of an exemplary embodiment of the structure allows it to be used with a wide range of explosive materials in addition to many types of removable initiators or detonators.

7 Claims, 5 Drawing Sheets

(56) References Cited

U.S. PATENT DOCUMENTS 4,817,532 A * 4/1989 Assmann ..... F42B 12/20 102/482
4,977,657 A * 12/1990 Engel ..... F42B 12/24 102/493
5,074,217 A * 12/1991 Gabriels ..... F42B 27/08 102/482
5,257,936 A * 11/1993 Ambrosi ..... F42B 8/18 102/529
5,658,452 A * 8/1997 Heyse ..... B01J 19/002 208/133
5,853,502 A * 12/1998 Aihara ..... C22C 38/22 148/225
7,036,432 B2 * 5/2006 Casenave ..... F42B 12/32 102/306
7,040,236 B2 * 5/2006 Oh ..... F42B 33/00 102/482
7,712,419 B1 * 5/2010 Cheng ..... F42C 14/02 102/254
8,272,328 B1 * 9/2012 Gorman ..... F42B 12/58 102/482
8,381,657 B1 * 2/2013 Hooke ..... F42B 8/26 102/481
8,661,979 B2 * 3/2014 Veksler ..... F42C 15/34 102/256
8,943,973 B2 * 2/2015 Mendes ..... F42B 12/387 102/486
9,255,777 B1 * 2/2016 Campagnuolo ..... F42C 14/02
2008/0202288 A1 * 8/2008 McKechnie ..... B01J 2/006 75/346
2011/0232466 A1 * 9/2011 Stratum ..... F42B 27/08 86/1.1
2012/0145029 A1 * 6/2012 Veksler ..... F42C 15/34 102/481
2012/0240806 A1 * 9/2012 Gonsalves ..... C06B 21/0041 102/275.11

* cited by examiner

ADVANCED FRAGMENTATION HAND GRENADE

CROSS-REFERENCE TO RELATED APPLICATIONS

The present application claims priority to U.S. Provisional Patent Application Ser. No. 62/020,109, filed Jul. 2, 2014, entitled "ADVANCED FRAGMENTATION HAND GRENADE," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 103,388) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present disclosure relates to hand grenades, and in particular fragmentation hand grenades. Conventional grenades have been in use as anti-personnel weapon for many years and current fragmentation grenades in use have been regarded as ineffective. Current models of fragmentation grenades have also been proven to be inconvenient to produce and maintain.

An exemplary embodiment of the present disclosure has improved performance in terms of fragmentation effects, e.g., lethality, represented by fragmentation number, mass, dispersion, and kinetic energy while still capable of providing traditional form, fit, and function of traditional grenades. Additionally, the grenade is improved throughout its logistical life cycle as production and maintenance, safety, and processing are improved. The design of an exemplary embodiment of an advanced fragmentation grenade can allow it to be used with a wide range of explosive materials as well as with many types of removable detonators depending upon the desired application. The advanced fragmentation hand grenade can be separated into individual components that can include an open body section, a top cap section, a removable detonator, and an explosive. This explosive can be preassembled to fit within the open body of the grenade. Additionally, the open body of the grenade can receive an embrittlement treatment.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1C:
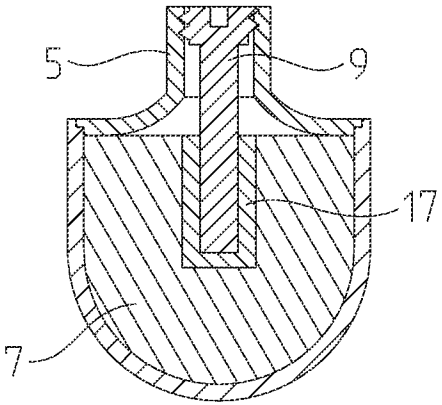
FIG. 1C shows a cross-sectional view of an exemplary embodiment of an advanced fragmentation hand grenade.
Figure 1B:
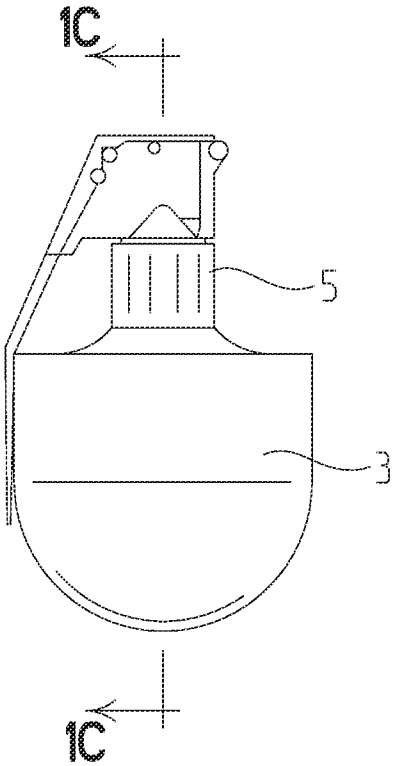
FIG. 1B shows a side view of an exemplary embodiment of an advanced fragmentation hand grenade.
Figure 1A:
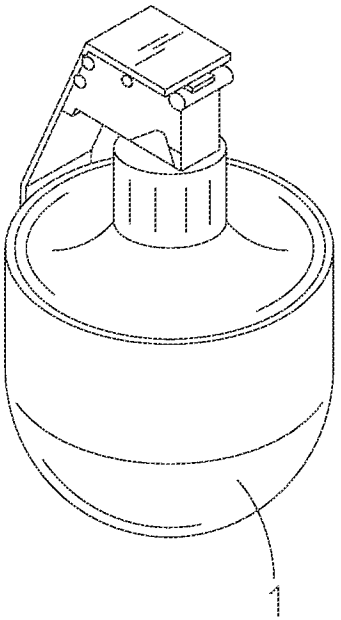
FIG. 1A shows perspective view of an exemplary embodiment of an advanced fragmentation hand grenade.

Referring initially to FIG. 1A, a new advanced fragmentation hand grenade 1 allows for the use of more energetic explosives and optimizes the position of the grenade fuse. FIG. 1B shows a side view of the advanced fragmentation hand grenade, which can be comprised of an open grenade body 3 and a top cap 5. FIG. 1C shows the cross-section of the advanced fragmentation hand grenade 1, which can include an open bottom grenade body 3 that allows for the insertion of a preassembled explosive core 7 of increased explosive energy. The explosive material can be pressed, cast, extruded or produced by any method and inserted into the grenade body 3. A preassembled explosive core 7 that can contain a detonator well liner 17 can be inserted into the grenade body 3. The grenade body can then be sealed by coupling it with the top cap 5. Final assembly can be completed by inserting in the removable detonator 9 through the top cap 5 and into the preassembled explosive core 7 contained in the grenade body 3. The top cap 5 and open grenade body can be coupled together by press fitting the two components together or through other coupling methods (i.e. threaded).

Figure 2:
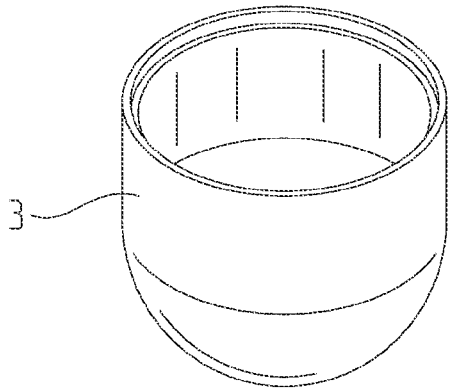
FIG. 2 shows a perspective view of the open bottom section of an exemplary embodiment of an advanced fragmentation hand grenade.

As seen in FIG. 2, the grenade body 3 can be hollow in the interior that allows for easy insertion of a preassembled explosive core 7 or the insertion of explosive material that can then be pressed, cast, extruded or produced by any other method. The grenade body 3 can be comprised of metal similar to conventional grenades, such as low carbon steel that aids fragmentation. However, the grenade body 3 can receive an embrittlement treatment, for example, through carburizing or carbonitriding. The embrittlement procedure can include embrittling an open grenade body by placing the said grenade body into a carbon rich and temperature controlled environment, allowing the material to absorb carbon from the surrounding carbon rich and temperature controlled environment, and cooling the material by a cooling agent to harden the grenade body. The interior or exterior surface of the grenade body 3 and the top cap 5 can be pre-scored or have a formed fragmentation pattern.

The embrittlement treatment can produce a grenade body that can be both harder and requires less energy to fragment the grenade body 3. The resulting fragments will be moving with greater velocity and will deliver more energy upon impact. The harder fragments will also be less consumed by the blast and be of higher mass. This allows for the fragments to have a higher penetrability. The embrittlement treatment also provides corrosion resistant properties which can eliminate some of the surface coating currently required. The embrittlement process can also help retain the metal processing advantages of low carbon steel but improves the fragmentation performance through post forming embrittlement of the grenade body 3. In other embodiments of the present disclosure, the top cap 5 can also receive an embattlement treatment depending on the desired application and configuration of the top cap 5 and grenade body 3.

Figure 3A:
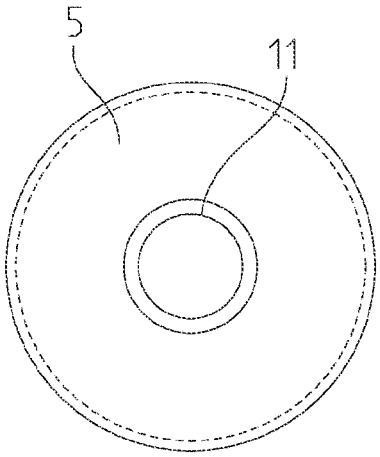
FIG. 3A shows a top view of the top section of an exemplary embodiment of an advanced fragmentation hand grenade.
Figure 3B:
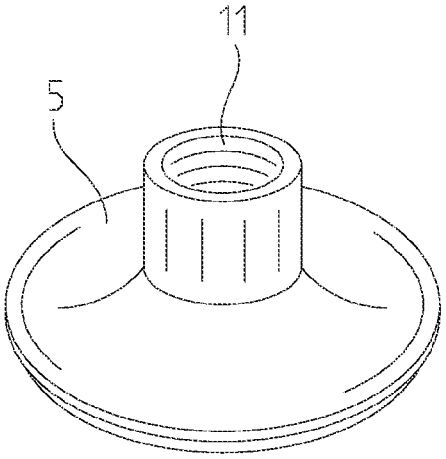
FIG. 3B shows a perspective view of the top section of an exemplary embodiment of an advanced fragmentation hand grenade.

Referring to FIG. 3A and FIG. 3B, the top cap 5 can include an aperture 11 that is capable of accepting the removable detonator 9. The aperture can be threaded to allow for a threaded removable detonator 9 to ensure stability of the connection between the top cap and the removable detonator 9. This can allow a user to use different types of initiating systems with the hand grenade which can include typical pin detonators or remotely operated detonators. The removable detonator 9 increases the versatility of the advanced fragmentation grenade by allowing for a user to change the type of detonator and therefore introducing the possibility of using alternate initiating systems thereby improving the grenades usefulness. Additionally, this lowers the maintenance costs of the grenade by allowing for a removable detonator and the enclosing the explosive with any kind of cap in place of the removable detonator.

Figure 4A:
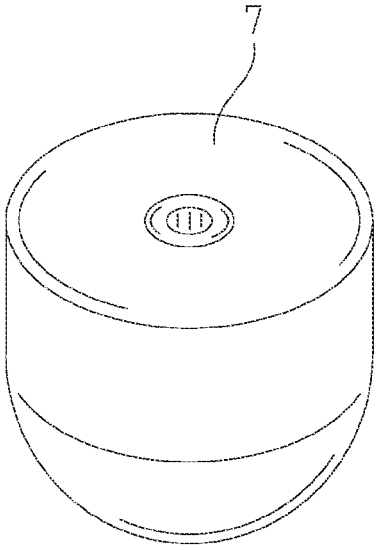
FIG. 4A shows a perspective view of an exemplary embodiment of a preassembled explosive core of an advanced fragmentation hand grenade.
Figure 4B:
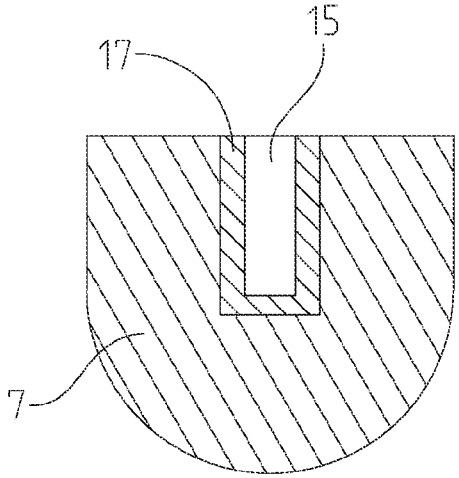
FIG. 4B shows a cross-sectional view of an exemplary embodiment of a preassembled explosive core of an advanced fragmentation hand grenade.

Referring to FIG. 4A and FIG. 4B, exemplary preassembled explosive core 7 can be inserted into a grenade body 3. The explosive core can be manufactured to have a detonator well 15 near the center of mass of the explosive for detonating said explosive so as to cause the casing to disintegrate into a plurality of high velocity fragments, where the high explosive and the casing are configured so that the fragments are preferentially projected in one or more particular directions relative to the axis of the grenade body 3. By making the location of the removable detonator 9 more efficient by placing it near the center mass of the preassembled explosive core 7 the velocity and pattern of the fragments are improved.

The detonator well in the preassembled explosive core 7 can also have a detonator well liner 17 isolating the explosive from the environment. The detonator well liner can assist in production and maintenance and will allow for the use of a removable detonator. A cylindrical portion of the grenade body 3 can be more suitable for adaption to include or generate increased external fragments or flechettes to further increase lethality. Early assessments suggest that the position of the detonator results in a grenade that can be easier to grip, especially with gloved hands, improving user safety.

Figure 5:
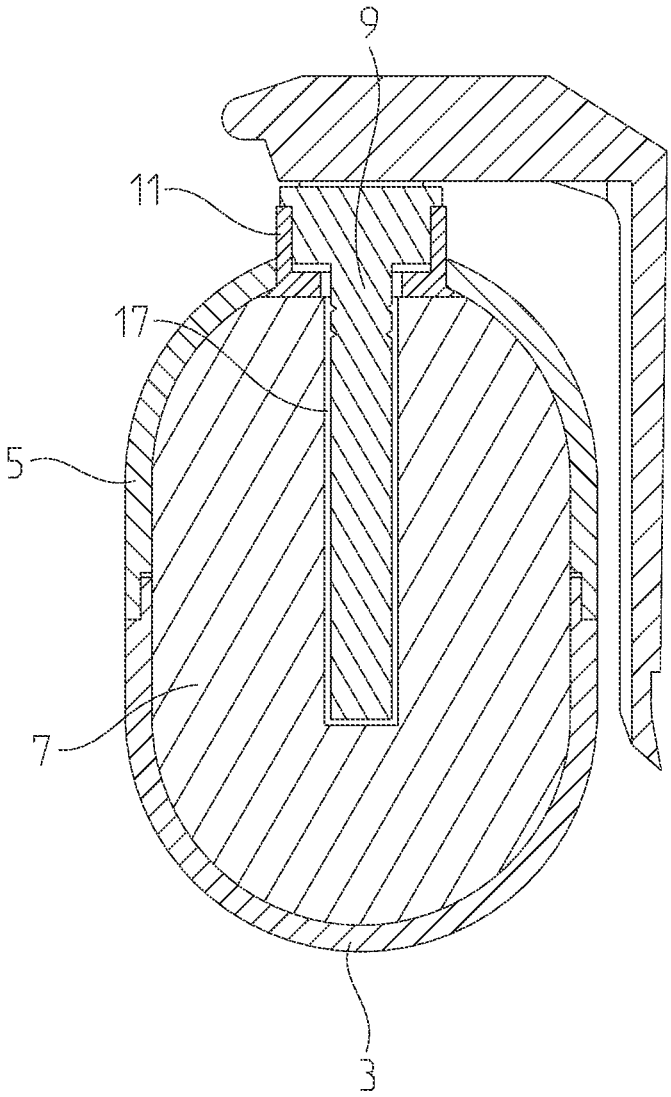
FIG. 5 shows a cross-sectional view of another exemplary embodiment of an advanced fragmentation grenade.

FIG. 5 shows another exemplary embodiment of the advanced fragmentation grenade where the top cap 5 and grenade body 3 are similarly shaped with the top cap 5 allowing the advanced fragmentation hand grenade to contain more explosive. While the top cap 5 is identical in shape to the grenade body 3 it can have a threaded aperture 11 to accept a removable detonator. The top cap 5 and the grenade body 3 can be coupled by press fitting the two together. Press fitting the top cap 5 and grenade body 3 to each other can maximize the fragmentation of the grenade while also eliminating a cumbersome step of the manufacturing process.

An ability of an explosive to propel fragments is primarily associated with its velocity of detonation. The greater the velocity of the detonation is, the larger the speed of the projected material in contact with the explosive. This can be approximated by the Gurney equations. The explosive that can be used in grenades is Composition B (Comp B). Typical grenade bodies are spherical with a single threaded opening. Comp B is melted and poured into the grenade body through this opening.

A velocity of detonation of Comp B can be approximately 7900 m/s. An exemplary embodiment of the present disclosure can incorporate explosives with velocities of approximately 110% of Comp B (e.g., i.e. 8700 m/s) or possibly even greater. Potential explosives can include PBXN-5, PBXN-9, as well as a version of Composition C4 incorporating HMX. A limitation to traditional grenade designs is that they require, by design, poured explosives like Comp B. Cast explosives typically have lower detonation velocity. The use of these alternate explosives comes from the fact that an exemplary embodiment of this disclosure has been designed to enable the use of pressed or extruded explosives with higher detonation rates. There is additional improvement in individual fragment kinetic energy initially and at five meters. This can be accomplished using the preassembled explosive core 7, which can also increase safety to the user and environment by helping to eliminate the use of Comp B and incorporating modern Insensitive Munitions (IM) explosives.

Figure 6:
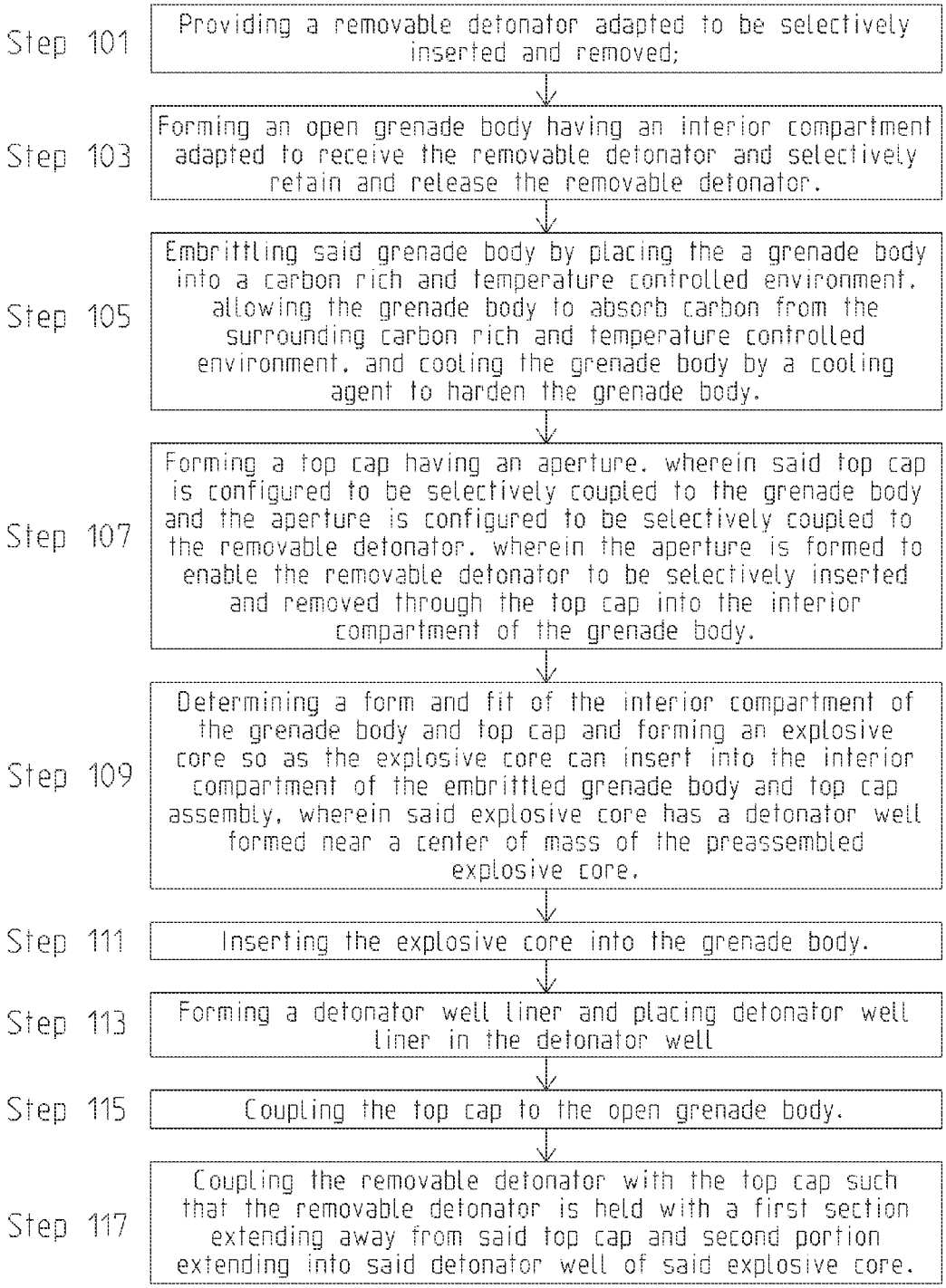
FIG. 6 shows an exemplary method of manufacturing an advanced fragmentation hand grenade.

A method of manufacturing an advanced fragmentation hand grenade is shown in FIG. 6 and can include:

Step 101: providing a removable detonator adapted to be selectively inserted and removed;

Step 103: forming an open grenade body having an interior compartment adapted to receive the removable detonator and selectively retain and release the removable detonator.

Step 105: embrittling said grenade body by placing the grenade body into a carbon rich and temperature controlled environment, allowing the grenade body to absorb carbon from the surrounding carbon rich and temperature controlled environment, and cooling the grenade body by a cooling agent to harden the grenade body.

Step 107: forming a top cap having an aperture, wherein the top cap is configured to be selectively coupled to the grenade body and the aperture is configured to be selectively coupled to the removable detonator, wherein the aperture is formed to enable the removable detonator to be selectively inserted and removed through the top cap into the interior compartment of the grenade body;

Step 109: determining a form and fit of the interior compartment of the grenade body and the top cap and forming an explosive core so the explosive core can insert into the interior compartment of the embrittled grenade body and top cap, wherein the explosive core has a detonator well formed near a center of mass of the preassembled explosive core;

Step 111: inserting the explosive core into the grenade body.

Step 113: forming the detonator well liner and placing the detonator well liner in the detonator well;

Step 115: coupling the top cap to the open grenade body;

Step 117: coupling the removable detonator to the top cap such that said the removable detonator is held with a first section extending away from the top cap and second portion extending into the detonator well of the explosive core.

A method, such as discussed in FIG. 6, can be based on components such as discussed in FIGS. 1-5 or other elements that produce effects or results associated with the invention.

Although the invention has been described in detail with reference to certain preferred embodiments, variations and modifications exist within the spirit and scope of the invention as described and defined in the following claims.

The invention claimed is:

1. A method of manufacturing an advanced fragmentation device comprising:

providing a removable detonator;

forming a device body having an interior compartment;

embrittling said device body by placing the said device body into a carbon rich and temperature controlled environment, allowing the device body to absorb carbon from a surrounding carbon rich and temperature controlled environment, and cooling the device body by a cooling agent to harden the device body;

forming a top cap having an aperture, wherein said top cap is configured to be coupled to said device body and said aperture is configured to be selectively coupled and retained to said removable detonator, wherein said aperture is formed to enable the removable detonator to be inserted through the top cap into the interior compartment of said device body;

determining a form and fit of the interior compartment of said device body and top cap and forming an explosive core according to said form and fit so as it can insert into said interior compartment of said embrittled device body and top cap, wherein said explosive core has a detonator well formed near the center of mass of said preassembled explosive core;

inserting said explosive core into said device body;

forming detonator well liner and placing detonator well liner in said detonator well;

selectively coupling and retaining said top cap to said device body; and coupling said removable detonator to said top cap such that said removable detonator is selectively held with a first section extending away from said top cap and second portion extending into said detonator well of said explosive core.

2. The method of claim 1, wherein the interior of said device body has a formed fragmentation pattern comprising areas of said body having a lesser structural strength than non pattern areas.

3. The method of claim 1, wherein the exterior of said device body has a formed fragmentation pattern comprising areas of said body having a lesser structural strength than non pattern areas.

4. The method of claim 1, wherein the coupling of said top cap to said device body is accomplished by press fitting them together.

5. The method of claim 1, wherein the top cap has an interior compartment.

6. The method of claim 1, wherein the aperture of said top cap is formed with a threaded section and said removable detonator has a threaded section.

7. The method of claim 1, wherein after the forming of said top cap, the top cap is embrittled by placing the said top cap into a carbon rich and temperature controlled environment, allowing the top cap to absorb carbon from the surrounding carbon rich and temperature controlled environment, and cooling the top cap by a cooling agent to harden the top cap.

* * * * *